United States Patent [19]

Ito et al.

[11] Patent Number: 4,921,155

[45] Date of Patent: May 1, 1990

[54] TAPE MATERIAL CONVEYING ROLLER AND TAPE MATERIAL CONVEYING METHOD

[75] Inventors: Takashi Ito, Hachioji; Norio Sakamoto, Sagamihara, both of Japan

[73] Assignee: Konica Corporation, Japan

[21] Appl. No.: 288,918

[22] Filed: Dec. 23, 1988

[51] Int. Cl.[5] ..... B65H 27/00; B65H 20/02

[52] U.S. Cl. ..... 226/181; 226/186

[58] Field of Search ..... 226/181, 190, 193, 182, 226/186; 242/76, 192

[56] References Cited

U.S. PATENT DOCUMENTS 3,340,576 9/1967 Pannill, Jr. et al. ..... 226/193 X
4,553,186 11/1985 Kawakami et al. ..... 226/193 X
4,599,661 7/1986 Muramatsu ..... 226/181 X

FOREIGN PATENT DOCUMENTS 690567 7/1964 Canada ..... 242/54
60-153360 8/1985 Japan .

*Primary Examiner*—Donald Watkins
*Attorney, Agent, or Firm*—Finnegan, Henderson, Farabow, Garrett & Dunner

[57] ABSTRACT

An apparatus for conveying a tape material having different surface moduli on either side by nipping with a pair of rotatable rollers and a method of conveying the same is disclosed. The tape material having different surface moduli is conveyed by an apparatus having a pair of rollers having different surface moduli with each other, so that the roller in contact with the relatively higher elastic modulus side of said tape has a relatively higher surface elastic modulus, and the roller in contact with the relatively lower elastic modulus side of the tape has a relatively lower surface elastic modulus.

4 Claims, 2 Drawing Sheets

TAPE MATERIAL CONVEYING ROLLER AND TAPE MATERIAL CONVEYING METHOD

FIELD OF THE INVENTION

The present invention relates to a tape material transporting apparatus, wherein by means of a liquid coating method such as a slide hopper method or by means of a gas-phase solid deposit method such as a vacuum deposit method, the tape material is provided with layers of intended applications such as a photographic emulsion layer, magnetic recording layer, and thermal recording layer, and, in particular, the invention relates to a pair of rollers that nip and transport the tape material.

BACKGROUND OF THE INVENTION

In the above-described technical field, when a tape material having a layer for an intended purpose is transported, the substrate and the coating layer of a tape material are provided with different properties to ensure the product quality that satisfies its intended purpose and to allow easy manufacturing. The physical properties of the front and the back surfaces of the tape material in this sense include an elastic modulus, a friction coefficient, surface roughness, and adhesion strength. Therefore, the correlation between these properties and the surface of a pair of rollers that nip and transport the tape material must be a due consideration.

When the rape material is nipped and transported by a pair of rollers, an excess nip force may physically damage the coating layer and/or substrate of the tape material and cause functional failure of the final product. For example, in the case of a photo-sensitive material having the emulsion layer on a substrate, excessive compression onto an emulsion layer causes pressure fogging. In the case of a magnetic material having magnetic material on a substrate, excessive compression on a magnetic layer causes fissure peel, resulting in failure in data-reproducing. A thermal recording tape causes printing failure owing to peel of thermal paint.

To ensure the requirements of stable transportation and positive quality control, Japanese Patent Open to Public Inspection (hereinafter referred to as Japanese Patent O.P.I. Publication) No. 118832/1979 is focused on a friction coefficient and recommends that an average roughness Ra of the roller surface be from 2 to 40 μm. According to the arrangement in Japanese Patent O.P.I. Publication No. 153360/1985, a free roller whose surface having a larger coefficient of friction is pressed onto a coating layer (photographic emulsion layer), while driving rollers of a smaller friction coefficient are pressed onto the back face of the tape material, wherein the revolutions of the driving rollers are gradually larger toward the direction of tape material transportation, thereby excessive friction and transportation tension on the coating surface are eliminated in order to prevent transportation-induced product failure.

In that patent specification, however, the nip pressure that is exerted between nipping roller pairs which significantly affects stable transportation is not specified; there is no clear correlation between the maximum nip pressure that does not cause damage to the tape material, the elastic modulus to be given to the tape material surface, and the elastic modulus that is given to the nipping roller surface. Accordingly, it is impossible with this arrangement to increase the nip pressure in order to ensure transportation stability, and high-speed operation.

SUMMARY OF THE INVENTION

The object of the present invention is to provide a tape material transporting roller and a tape material transporting apparatus that are capable of positively ensuring the product quality of the tape material having a coating layer for an intended purpose, and that are capable of stable and high-speed transportation.

The object of the invention described above is achieved by a tape material transporting apparatus comprising a pair of rollers, wherein the elastic modulus of rollers in contact with the surface having a smaller elastic modulus on a tape material, either the front or back face, is designed to be smaller than that of rollers in contact with a tape material surface having a larger elastic modulus.

Figure 1:
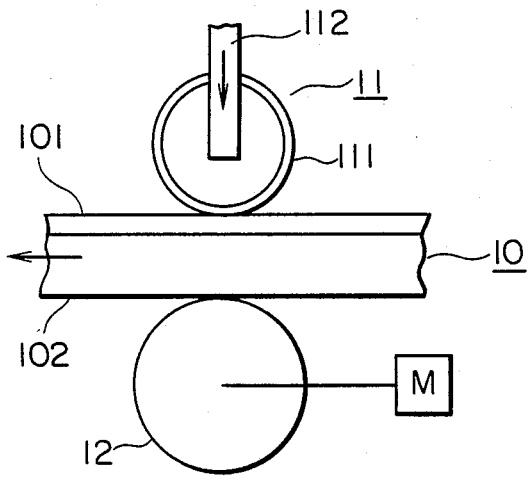
FIG. 1 illustrates a status of a color film being transported.

Numerals in the figures represent the following elements: 10, tape material; 101, coating layer; 102, substrate; 11, free roller; and 12, driving roller.

DETAILED DESCRIPTION OF THE INVENTION

The effect of the present invention can be advantageously achieved when the invention is incorporated into a transport mechanism used in manufacturing a tape material of photographic sensitive materials (such as X-ray film, color film, and photographic print paper), a tape material of magnetic recording medium, and thermal recording material; or when the invention is incorporated into an apparatus for subjecting a final product, i.e. a the strip of film or tape, to picture-taking, recording, and data-reproducing.

The essence of the invention lies in adjustment of the elastic modulus of the tape material surface to that of the surface of the roller. Therefore, the scope of the invention includes means for forming an elastic modulus regulating layer on the back face of the tape material in order to ensure the object of the invention.

Next, the invention is described in detail by using, as an example, a transportation for tape material by means of nip rollers, where the tape material is for a color photographic light-sensitive material whose quality of coating layer formed on the tape material is extremely sensitive and vulnerable to outside stimuli.

Transportation for a color photographic light-sensitive material (hereinafter referred to as a color film) requires stricter protection, than that for other types of tape material, against pressure-induced damage (as typified by pressure fogging), and scratches, wherein transportation must be performed free of slippage or tension fluctuation.

To satisfy these requirements, the inventors have performed studies including the arrangement in the previously mentioned Japanese Patent O.P.I. Publication No. 118832/1979 that recommends that the roller surface be provided with an average roughness Ra of from 2 to 40 μm; and the arrangement in Japanese Patent O.P.I. Publication No. 153360/1985 that recommends that the free roller surface in contact with the emulsion layer be provided with a larger friction coefficient, and the revolutions of the driving rollers being gradually larger toward the direction of tape material transportation. As a result, the inventors have learned that the elastic moduli of the substrate and emulsion layer surface of the color film tape material, as well as the elastic moduli of the roller surfaces that are in contact with these surfaces, have greater influences on the above-mentioned requirements than the above-mentioned criteria.

In the case of the color film tape material, the elastic modulus of the emulsion layer surface is usually smaller than that of the color film tape material and the elastic modulus of the emulsion layer surface is usually smaller than that of the substrate. However, from the findings described above it has been determined that, according to the invention, the free roller surface in contact with the emulsion layer is provided with an elastic modulus smaller than that of the driving roller, and that the elastic modulus of the free roller is preferably smaller than that of the emulsion layer.

According to the preferred embodiment of the invention, the order of elastic moduli from higher to lower on the above-mentioned four surfaces is preferably, "driving roller >free roller", and, more preferably, "driving roller >substrate>emulsion layer (dry)>free roller.

FIG. 1 illustrates the status of a color film tape material being transported, wherein numeral 10 represents a color film; 101, emulsion layer; and 102, substrate.

Numeral 11 represents a free roller that is pressed onto the emulsion layer and whose surface has a coating layer 111 of a small elastic modulus, made of neoprene rubber , silicon rubber, urethane rubber or the like.

Numeral 12 represents a driving roller that is pressed onto the tape material surface (tape material back face) and transports the tape material 10, driven by a power source M, and the roller is made of a materials such as iron or aluminum, or of a resin such a polycarbonate, polyethylene, and polyacetal, whose surface has hard chromium plating. The elastic modulus of this roller is greater than that of the free roller 11.

The pair of rollers 11 and 12 exert a nip pressure on the tape material 10 via a presser member 112 of the free roller 11.

Figure 2:
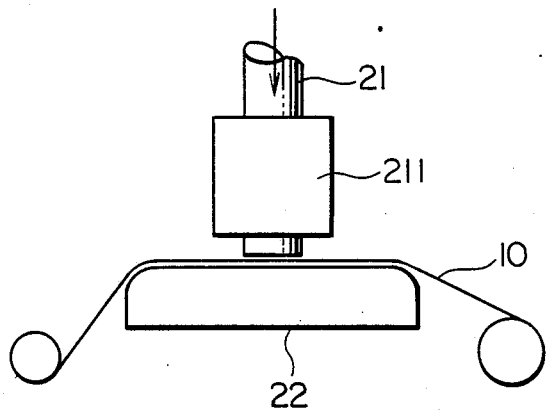
FIG. 2 schematically illustrates a presser mechanism.

Next, the operation of the invention is described by referring to the pressure test results using the presser apparatus shown in FIG. 2.

In FIG. 2, numeral 21 represents a stressing pin that exerts a static pressure or impact pressure on the tape material 10; 211 represents a linear ball bearing that stabilizes the stressing pin in the pressure axial direction, wherein the stressing pin is connected to a pnuematic cylinder (unshown), thereby the stressing pin can arbitrarily generate static pressure or impact pressure; 22 represents a stress receiving board that exerts the nip pressure on the tape material 10 in conjunction with the stressing pin.

The tape material 10 is placed on the stress receiving board 22 so that the emulsion layer surface of the substrate faces the stressing pin 21.

The faces, that contact with the tape material, of the steel and the stress receiving board can be arbitrarily replaced with faces having hard chromium plating (thickness, 0.01 mm) or rubber coating (hard neoprene rubber; thickness, 1.0 mm).

In the pressure test performed in a darkroom with a color film under predetermined pressure conditions, wherein the combined condition of elastic moduli of the tape material surface, and nip surfaces in contact therewith (the stressing pin face and the stress receiving board) was varied, and after 30 seconds of pressure application, the operation of the invention was evaluated based on the density of pressure fog.

The pressure fog was evaluated using an unexposed color film that had undergone developing, by comparing the fog density ΔD on the pressurized portion with that of the non-pressured portion.

(1) Static pressure test

The stressing pin was allowed to contact with the tape material surface, and a static pressure of 4 kg/mm$^2$ was exerted for 30 seconds. The results are summarized in Table 1.

TABLE 1

| Factor Condition | Stressing pin face | Stress receiving board | Tape material surface to stressing pin | ΔD/ΔD |
|---|---|---|---|---|
| 1 | Rubber | Chromium | Emulsion | 1.0 |
| 2 | Rubber | Chromium | Substrate | 3.2 |
| 3 | Chromium | Rubber | Emulsion | 11.0 |
| 4 | Rubber | Rubber | Substrate | 17.8 |
| 5 | Rubber | Rubber | Emulsion | 19.0 |
| 6 | Chromium | Chromium | Emulsion | 21.0 |
| 7 | Chromium | Rubber | Substrate | 22.8 |
| 8 | Chromium | Chromium | Substrate | 28.0 |

($\Delta D_1$ represents the density difference according to Condition 1)

Figure 3:
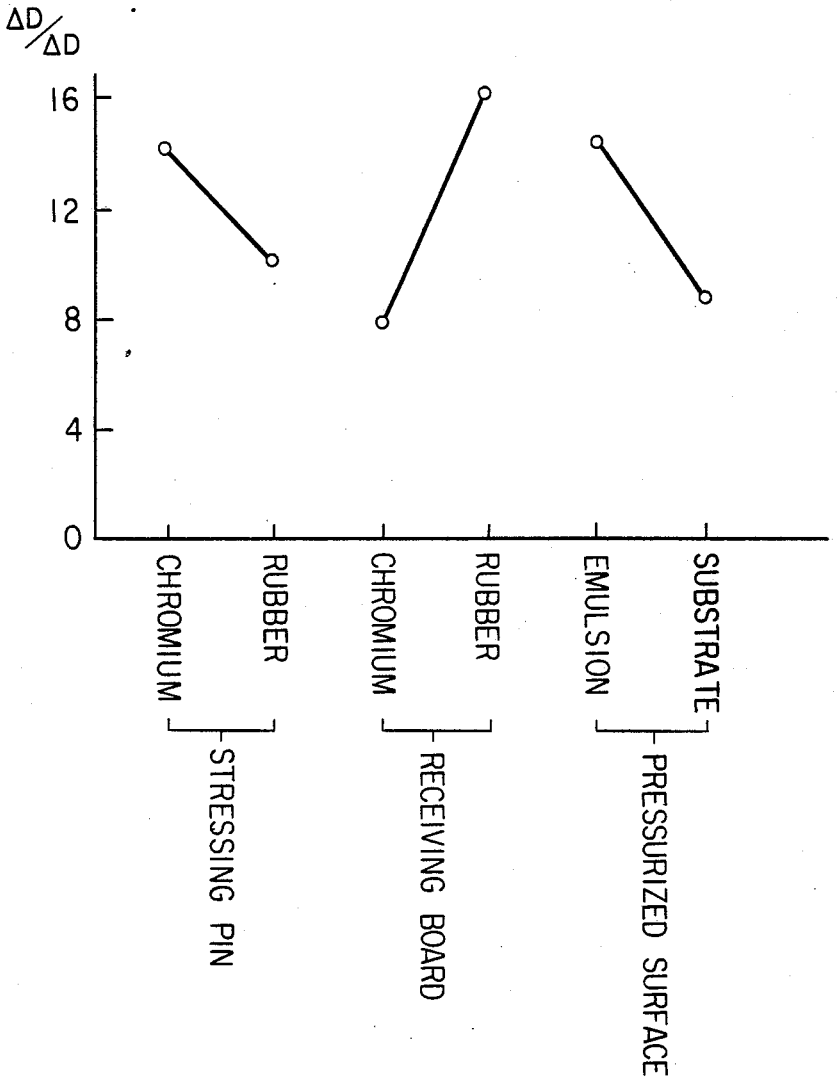
FIG. 3 is a graph showing average fog levels relative to pressure fogging.

Based on the above-listed data, average fog levels of combined conditions involving a stressing pin, stress receiving board, and the surface for receiving pressure were determined and plotted to make FIG. 3.

Table 1 and FIG. 3 jointly clarify the conditions for minimizing the pressure fogs, and the requirements of the invention apparent, wherein Condition 1 achieved the best result.

(2) Impact pressure test

Impact pressure is exerted on the tape material every time a specific portion of the tape material is fed into a pair of rollers that are rotating with a specific nip pressure. Though having an orientation slightly different from the impact, a standard pressure for simulation was generated by exerting a vertical impact on the tape material placed on the stress receiving board the pressure fog which occurred was evaluated.

The results obtained are summarized in Table 2.

TABLE 2

| | Stressing pin face | Stress receiving board | ΔD |
|---|---|---|---|
| 1 | Rubber | Chromium | 1.0 |
| 2 | Chromium | Chromium | 14.0 |

Note:
impact velocity
1.6 m/sec.
static pressure
4 kg/mm$^2$
$\Delta D_1$ represents density difference according to Condition 1.

As can be understood from the results in Table 2, rubber coating on the surface of the stressing pin drastically decreased the pressure fog to 1/14, whereby the impact arising from the tape material being fed into the nip portion is damped. Therefore, the only consideration needed is the static pressure on the nip portion, thereby control in tape material manufacturing is positive, simple, and effective.

The combined conditions of the pressure test mentioned above are more arduous than those of practical tape material manufacturing. The apparatus of the invention can cope with such severe conditions, thereby the apparatus is capable of transporting the tape material without being hindered by limitations on the nip pressure, and, it is possible to increase the nip pressure in order to stabilize and accelerate tape material transportation. Under the conditions for industrial operation, product quality failure such as specks of pressure fog can be eliminated, even when a contaminant such as dust erroneously enters the nip portion.

Embodiments

The present invention is hereunder described in detail referring to the preferred embodiments of the invention.

Embodiment 1

The transportation nip roller was used in transportation for coating and post-drying transportation of a color photographic light-sensitive material.

| | |
|---|---|
| Elastic moduli of tape material: | |
| Color photographic emulsion layer; | 200–300 kgf/mm$^2$ |
| Substrate (cellulose acetate); | 400 kgf/mm$^2$ |

Usually, the side opposite to the emulsion layer of the substrate is subjected to surface treatment that does not adversely affect the elastic modulus of this side.

Surface elastic moduli of nip roller:

| | Embodiment | Comparative |
|---|---|---|
| Emulsion side | Rubber 0.2 kgf/mm$^2$ | Rubber 0.2 kgf/mm$^2$ |
| Substrate side | Chromium 20700 kgf/mm$^2$ | Rubber 0.2 kgf/mm$^2$ |
| Locations | 10 | |
| Nip pressure | 1.5 kgf/mm$^2$ | |
| Transportation velocity | 120 m/min. | |

In the transportation operation according to the conditions of the embodiment above, the number of damaged products caused by transportation was 1/20 of the comparative example.

To prevent damaged products caused by pressure or friction, conventional transportation methods such as an air roller system are available. However, such methods are not readily accepted owing to conditions such as manufacturing costs, installation room, and maintenance. In contrast, the apparatus according to the invention transported the tape material at higher speed and with lower product failure rate, without incurring a complicated mechanism and high cost, wherein the tape material had a substrate coated with a material and was vulnerable to mechanical stress, as in the case of a light-sensitive material.

According to the invention, by measuring the elastic moduli of both faces of the tape material, and of roller materials, it has become possible to determine the material of transport rollers that is suitable for the tape material.

Embodiment 2

Color paper

| Elastic modulus of emulsion layer on tape material: 300 kgf/mm$^2$ Elastic modulus of substrate on tape material: 150–200 kgf/mm$^2$ | | |
|---|---|---|
| Nip roller | Embodiment | Comparative |
| Surface elastic modulus of roller to emulsion side | Chromium 20700 kgf/mm$^2$ | Rubber 0.2 kgf/mm$^2$ |
| Surface elastic modulus of roller to substrate (back) | Rubber 0.2 kgf/mm$^2$ | Rubber 0.2 kgf/mm$^2$ |
| Locations | 10 | |
| Nip pressure | 1.5 kgf/mm$^2$ | |
| Transportation velocity | 120 m/min. | |

In the tape material transportation operation under the conditions of the embodiment specified above, the failure occurrence such as pressure-induced blue-desensitization was decreased to 1/10 of the comparative example.

Adjusting the elastic moduli of the surface of the tape material transport roller and of the surface of the tape material being transported, as specified by the invention, positively ensures product quality and improves manufacturing productivity.

What is claimed is:

1. An apparatus for conveying a tape having first and second opposite sides of different elastic moduli, the apparatus comprising:

a first and second roller for nipping the tape therebetween, said first and second roller being rotatable for conveying the tape, said first roller contacting the first side of the tape and having an elastic modulus greater than the elastic modulus of the first side, said second roller contacting the second side of the tape and having an elastic modulus less than the elastic modulus of the second side.

2. The apparatus of claim 1, wherein the elastic modulus of the first roller is greater than the elastic modulus of the first side, the elastic modulus of the first side is greater than the elastic modulus of the second side, and the elastic modulus of the second side is greater than the elastic modulus of the second roller.

3. The apparatus of claim 2, wherein the first roller is a driving roller.

4. The apparatus of claim 2, wherein the second roller is a free roller.

* * * * *